United States Patent [19]

Poole

[11] Patent Number: 4,558,271

[45] Date of Patent: Dec. 10, 1985

[54] POWER INDUCTIVE COUPLERS

[75] Inventor: Douglas P. Poole, Bristol, England

[73] Assignee: Marconi Avionics Limited, England

[21] Appl. No.: 587,233

[22] Filed: Mar. 7, 1984

[30] Foreign Application Priority Data

Mar. 11, 1983 [GB] United Kingdom ..... 8306738

[51] Int. Cl.[4] ..... G05F 3/06

[52] U.S. Cl. ..... 323/306; 323/302; 323/356; 333/24 R

[58] Field of Search ..... 323/301, 302, 306, 355, 323/356, 901, 908; 333/24 R

*Primary Examiner*—Peter S. Wong
*Assistant Examiner*—Anita M. Ault
*Attorney, Agent, or Firm*—Kirschstein, Kirschstein, Ottinger & Israel

[57] ABSTRACT

A two-part separable inductive coupler is provided in one part with a current-limiting reactor whose control winding is energized by control means in response to the formation of a magnetic circuit between primary and secondary windings incorporated in said one part and the other said part respectively. Said control means may comprise a rectifier connected across said primary winding and is arranged to saturate the reactor when the coupler parts are connected and leave the reactor unsaturated when the parts are separated, so as to limit the primary current.

11 Claims, 4 Drawing Figures

POWER INDUCTIVE COUPLERS

This invention relates to separable inductive couplers and particularly but not exclusively, to power inductive couplers of the type used for connecting under-sea cables.

U.K. Patent No. GB 2 020 116B discloses a power inductive coupler which consists, in principle, of a transformer, split into two parts, the primary winding being linked to one half core and the secondary winding being linked to the other half core.

When the core half carrying the secondary is parted from the other core half there is a considerable drop in the impedance of the coupler primary. For series connection of several couplers, current limiting is desirable if the output of the remaining couplers is to remain sensibly constant, and if the couplers are to be connected in parallel, current limiting is essential to prevent a disconnected coupler presenting a short circuit to the cupply.

As proposed in the aforementioned U.K. Patent, current limiting is achieved by the incorporation of a leakage loop in the primary half of the coupler. This method is relatively inefficient however; in practice the current is limited to five times the normal operating value.

Ideally a current limiting device should only start to operate as the coupler is separated, and should limit the current to the normal operating value for the coupler so that the overall system is unaffected.

According to the present invention a separable two-part inductive coupler comprises in one part a primary winding and in the other part a secondary winding, said windings being so disposed within said parts as to be mutually coupled by a common magnetic circuit formed when said parts are operably adjacent, wherein said one part further includes a current limited saturable reactor provided with:

(a) a choke winding connected in series with said primary winding, (b) control means responsive to the formation of said magnetic circuit, and (c) a control winding arranged to be energised by said control means in response to the formation of said magnetic circuit so as to saturate said saturable reactor when said parts are operably adjacent and to leave said saturable reactor unsaturated when said parts are separated.

The parts of the coupler may be provided with mating faces and means such as hydraulic actuator for locking said faces together.

Said control winding may be energised by D.C.

In one particular embodiment of the invention the control winding is connected to receive a voltage derived by the primary winding by being in parallel across the latter winding. In another embodiment there is a further winding connected in parallel with the control winding and inductively coupled to the primary winding.

Preferably the current limiter is a balanced saturable reactor.

Two embodiments of the invention will now be described by way of example with reference to the accompanying drawings in which:

FIG. 1. shows one circuit arrangement for a pair of series-connected couplers;

Figure 1:
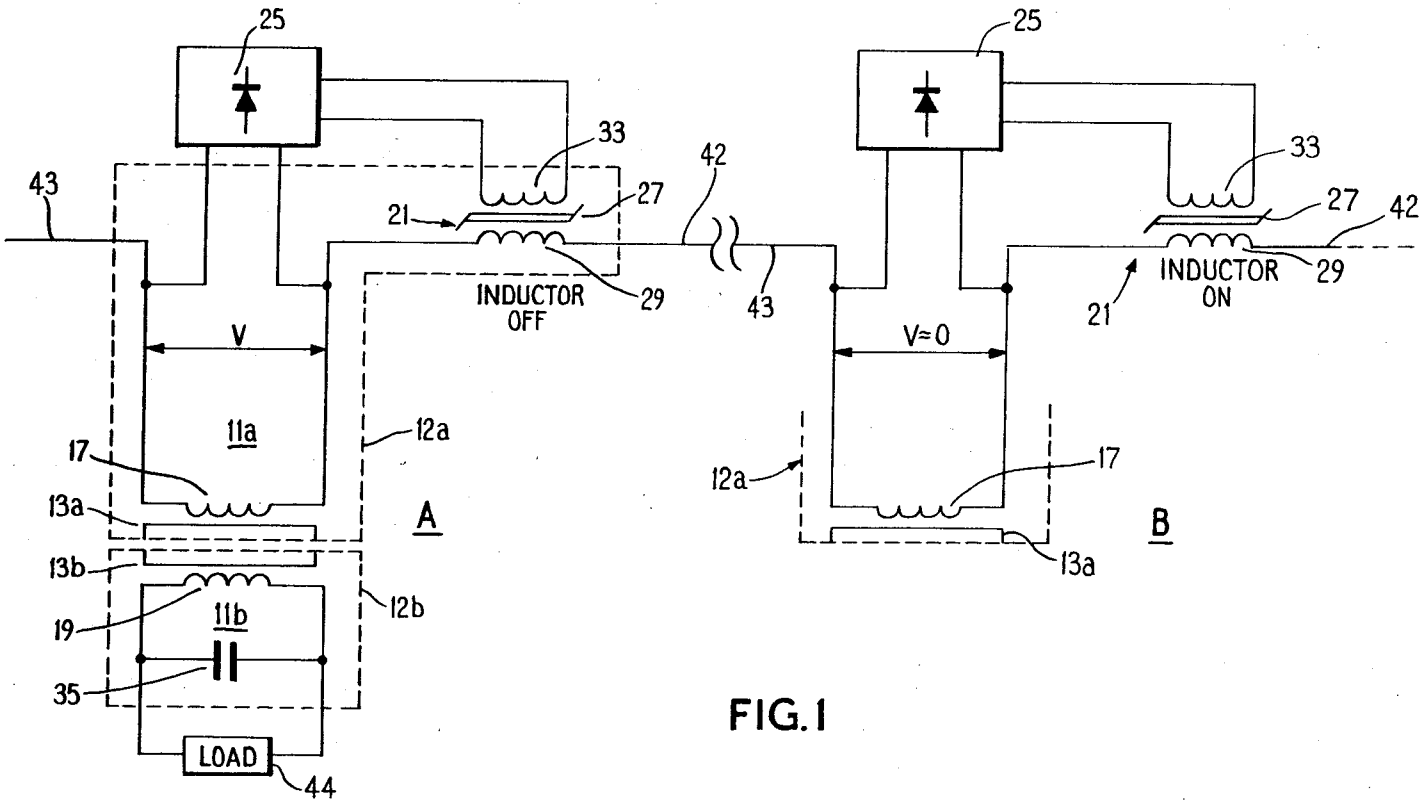
Figure 3:
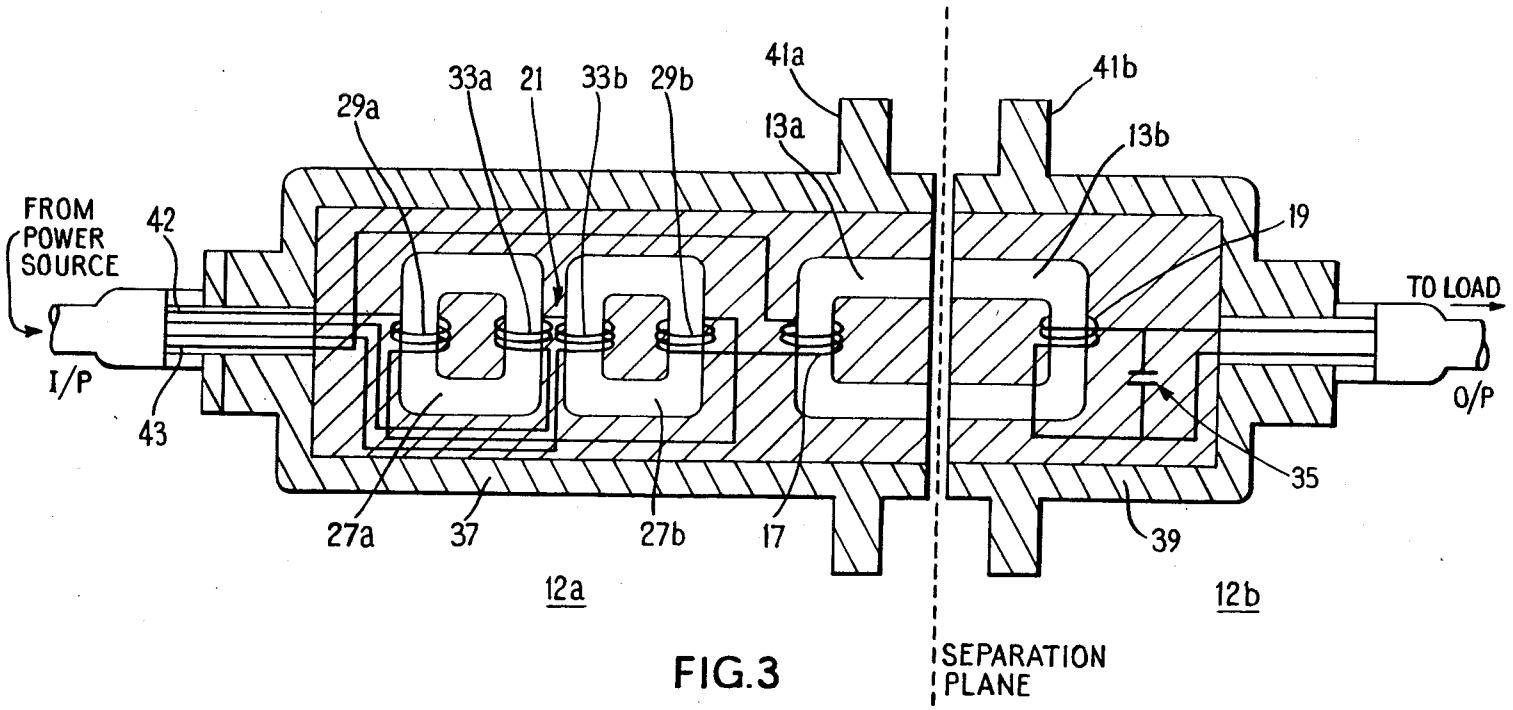
FIG. 3 shows diagrammatically a longitudinal section through an undersea power inductive coupler embodying the circuit arrangement of FIG. 1.

Referring to FIGS. 1 and 3 the first inductive coupler to be described has two magnetic circuit parts, 11*a*, 11*b*, respectively incorporated in two mechanically separable mating parts 12*a*, 12*b*. Thus, the coupler includes a ferromagnetic core 13 in two parts 13*a*, 13*b* (FIGS. 1 and 3) which are so constituted and so positioned in their respective coupling parts 12*a*, 12*b* that when the parts are brought together, they form a substantially gapless magnetic circuit. It will be appreciated, however, that the mating faces of the coupler parts may be covered by a thin layer of plastics material in order to protect the cores from corrosion by sea-water. There is a primary winding 17 linked to the core part 13*a* and a secondary winding 19 linked to the core part 13*b*. Connected in series with the primary 17 there is the inductor or "choke" winding 29 of a current limiter in the form of a saturable reactor 21 the control winding 33 of which is connected as shown in FIG. 1, with a bridge rectifier 25 to receive a d.c. voltage derived from the voltage induced in the primary winding 17.

As shown in FIG. 3, the core parts 13*a* and 13*b* each comprise a stack of C-shaped silicon iron laminations. The saturable reactor 21 is a balanced reactor which has two magnetic cores, 27*a*, 27*b*, each in the form of a stack of silicon-iron laminations. The balanced inductor or choke windings, 29*a*, 20*b*, respectively linked to the cores, 27*a*, 27*b*, are in series with each other, with the primary winding 17 linked to the half-core 13*a*. The common control winding arrangement 33 of the balanced saturable reactor comprises a pair of balanced windings 33*a*, 33*b*, one on each of the cores 27*a*, 27*b*. The balanced choke windings are connected in series (FIG. 1) across the voltage rectifier 25 which is energised by the voltage appearing across the primary winding 17.

A capacitor 35 is connected across the secondary winding 19 and causes the coupler to act as a ferroresonant circuit at the frequency of the coupler a.c. power source. The magnetic condition of the core 13 is, in consequence, substantially independent of supply voltage over an extended range of supply voltage, with good resultant output voltage regulation. Details of a suitable ferroresonant secondary circuit are given in the aforementioned U.K. patent specification No. GB 2,020 116B, which is hereby incorporated by reference.

The cores 27*a*, 27*b* and the core half 13*a*, together with their windings, are housed in one part 37 of a two part casing of stainless steel; and the core half 13*b*; the capacitor 35 and the secondary 19 are housed within the other casing part 39. The components are embedded in an epoxy resin based compound, the free end surfaces of the core halves 13*a*, 13*b* being left exposed (or covered with a thin protective covering) so that they may be brought into close butting contact. The two casing parts have external flanges 41*a*, 41*b*. If the coupling is intended for application in deep sea environments the flanges 41*a*, 41*b* may be engaged by hydraulic remotely operable actuator of any suitable known type (not shown). The two casing parts and, hence, the exposed end surfaces of the core halves 13*a*, 13*b*, may be hydraulically separated or brought to butting contact by remote operation of the associated hydraulic circuit (not shown). In shallow water conditions the flanges may be bolted together.

In operation, the coupler is energized from an a.c. power source (not shown) connected to conductors 42 and 43 and drives a load 44 connected across secondary winding 19. When the core halves 13*a*, 13*b* are in intimate butting contact as indicated in the case of the left-hand coupler A of FIG. 1, winding 17 has a high impedance which is essentially determined by the turns ratio of primary winding 17 to secondary winding 19 and the impedance of the output circuit. Under these conditions a high proportion V of the input voltage appears across winding 17 which when rectified by rectifier 25 (FIG. 1) drives a current through control windings 33*a* and 33*b* which is sufficient to saturate cores 27*a* and 27*b*. Consequently the inductance of windings 29(*a*) and 29(*b*) falls to a very low value, causing V to increase and drive cores 27*a* and 27*b* further into saturation. Thus when primary winding 17 sees a high impedance (parts 12*a* and 12*b* connected) current limiter 21 stabilises in a saturated state and dissipates very little power.

If, however, parts 12*a* and 12*b* are separated as indicated by the removal of part 12*b* of coupler B in FIG. 1, winding 17 becomes a low value inductance with a correspondingly low impedance. Voltage V falls so that windings 33*a* and 33*b* no longer saturate cores 27*a* and 27*b*. Windings 29*a* and 29*b* are designed so as to generate m.m.f.'s which in the absence of any m.m.f. from control winding 33 are insufficient to saturate cores 27*a* and 27*b* even when winding 17 is effectively a short circuit. Consequently windings 29*a* and 29*b* possess appreciable inductance when winding 17 is effectively short-circuited and thereby limit the current through the primary circuit to a predetermined safe value when the connector parts 12*a* and 12*b* are separated. By a suitable choice of core material for cores 27*a* and 27*b* and by providing a suitable number of turns on windings 29*a* and 29*b* the value of the input current through the primary circuit when connector parts 12*a* and 12*b* are separated may be arranged to be approximately equal to the mean demanded input current when parts 12*a* and 12*b* are connected. Two or more such couplers may then be connected in series and will be substantially unaffected by the mutual disconnection of the mating parts 12*a* and 12*b* of any connector. Owing to the ferroresonant behaviour of capacitor 35 in conjunction with secondary winding 19, any small changes in input voltage which do occur will cause only minimal changes in the output voltages of the connectors.

The circuit of FIG. 1 is not suitable for parallelconnected connectors because the voltage V will not fall to zero on disconnection of a pair of connector parts, causing the associated reactor cores to remain saturated.

Figure 2:
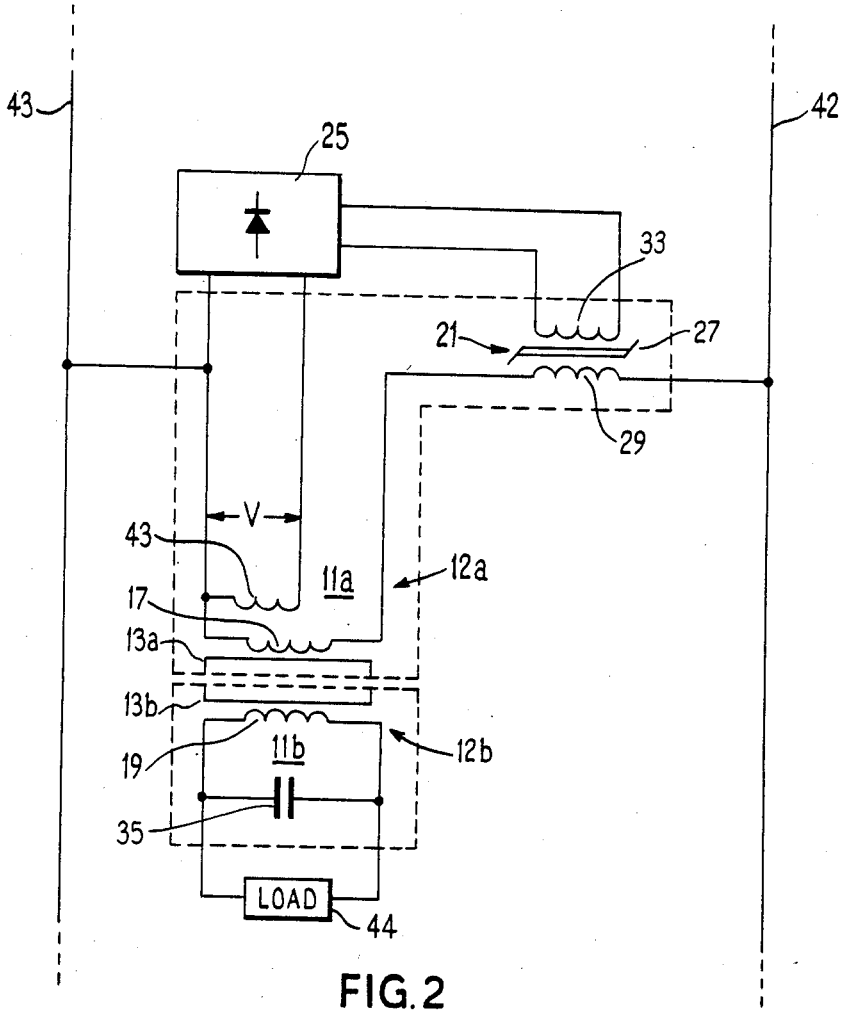
FIG. 2 shows a circuit arrangement employable for either series or parallel connected couplers.

In a modification of the circuit of FIG. 1 for parallel-connected connectors, instead of taking the d.c. control voltage from the primary winding 17, the required d.c. voltage may be obtained from a further winding 43 wound on the half core 13*a* with which the primary winding 17 is linked, as shown in FIG. 2. Apart from the extra winding on core 13*a*, the mechanical construction of the connector may be substantially as shown in FIG. 3. As the casing parts, 37, 39 are separated the voltage on the windings 33*a*, 33*b* will fall and the inductor windings 29*a*, 29*b* are, in consequence, activated, since the inductance of winding 43 will fall when the cores 13*a* and 13*b* are separated. The use of a further winding 43 allows greater flexibility in the design and enables a higher current limit to be set by current limiter 21. It should be noted that this circuit is particularly applicable to parallel-connected coupler arrangements but is also applicable to series-connected couplers.

It will be appreciated that whilst a balanced saturable reactor arrangement has been described above by way of example an unbalanced configuration could be employed instead. In such a configuration a single d.c. control winding and a single inductor or choke winding are wound on a single core. However a.c. in the latter winding gives rise to a.c. in the control winding by transformer action. This represents a waste of power, demands an increase in cross section of the wire employed in the control winding, and may call for insulation of the control winding to withstand high induced voltages. For these reasons the use of a balanced saturable reactor is usually desirable.

With the control or inductor winding 33 split, the total a.c. flux through the control winding or windings is zero, but the d.c. control flux still has the effect of varying the incremental permeability of the core or cores and hence, the inductance of the reactor.

Figure 4:
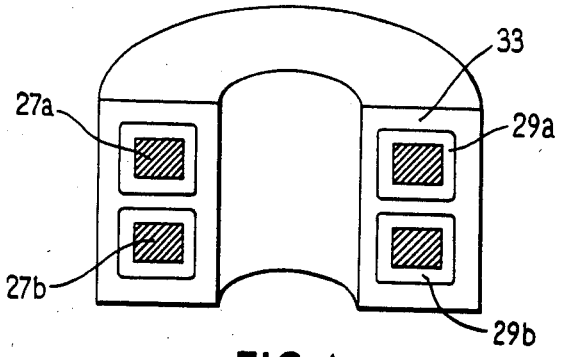
FIG. 4 is a sketch partially cut away, showing the construction of a saturable reactor as employed in the embodiment of FIG. 3.

With reference to FIG. 4 the saturable reactor 21 suitably has, as shown, two magnetically soft toroidal silicon-iron cores 27*a* and 27*b* on which are wound toroidal balanced a.c. inductor windings 29*a* and 29*b*, a single toroidal control winding 33 being wound overall.

The embodiments of the invention described by way of example hereinabove have the following merits:

(a) When the coupler is in normal oepration the reactor presents very little impedance to the circuit and dissipates little power other than that required to maintain the core in saturation - this can be kept low by careful choice of core material.

(b) If the coupler is separated the reactor provides an impedance which can be designed to be equivalent to the impedance of the normally operating coupler so that any number of couplers may be separated with little effect on the remaining couplers.

(c) Because of the time taken by the magnetic fields in the coupler and reactor to collapse or grow, the change from coupler impedance to reactor impedance is smooth and does not generate the transients associated with other switching devices.

I claim:

1. A separable two-part inductive coupler comprising in one part a primary winding and in the other part a secondary winding, said windings being so disposed within said parts as to be mutually coupled by a common magnetic circuit formed when said parts are operably adjacent, wherein said one part further includes a current limited saturable reactor provided with:

(a) a choke winding connected in series with said primary winding, (b) control means responsive to the formation of said magnetic circuit, and (c) a control winding arranged to be energised by said control means in response to the formation of said magnetic circuit so as to saturate said saturable reactor when said parts are operably adjacent and to leave said saturable reactor unsaturated when said parts are separated.

2. An inductive coupler as claimed in claim 1 wherein said primary and secondary windings are wound on respective ferromagnetic members which members are so shaped and disposed as to form a substantially gapless common ferromagnetic core when said parts are operably adjacent.

3. An inductive coupler as claimed in claim 2, further comprising a capacitance connected across said secondary winding, the value of said capacitance being such that in use, said magnetic circuit is ferroresonant.

4. An inductive coupler as claimed in claim 2 wherein said control means comprises rectifier means for energising said control winding with D.C.

5. An inductive coupler as claimed in claim 4, where said rectifier means is arranged to rectify A.C. derived from a winding coupled to said magnetic circuit.

6. An inductive coupler as claimed in claim 5, wherein said winding coupled to said magnetic circuit is said primary winding.

7. An inductive coupler according to claim 1 wherein the unsaturated inductance of said choke winding is sufficient to limit the current through the primary winding to a value which is approximately equal to a typical demanded primary current when said parts are operably adjacent and said secondary winding is connected to a load.

8. An inductive coupler as claimed in claim 1 wherein said choke winding and said control winding are both balanced windings.

9. An inductive coupler according to claim 2 wherein said choke winding and said control winding are both balanced windings.

10. An inductive coupler as claimed in claim 8 wherein said saturable reactor comprises two adjacent ferromagnetic toroidal cores disposed about a common axis, said cores being common to said control winding and balanced sections of said choke winding being wound individually on said cores.

11. An inductive coupler according to claim 10 wherein said saturable reactor comprises two adjacent ferromagnetic toroidal cores disposed about a common axis, said cores being common to said control winding and balanced sections of said choke winding being wound individually on said cores.

* * * * *